US007612494B2

(12) United States Patent
Shioya

(10) Patent No.: US 7,612,494 B2
(45) Date of Patent: Nov. 3, 2009

(54) IMAGE DISPLAY APPARATUS HAVING ACCELERATING ELECTRODE WITH UNEVEN THICKNESS

(75) Inventor: Yasushi Shioya, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 476 days.

(21) Appl. No.: 11/189,786

(22) Filed: Jul. 27, 2005

(65) Prior Publication Data

US 2006/0038483 A1 Feb. 23, 2006

(30) Foreign Application Priority Data

Aug. 18, 2004 (JP) ..... 2004-238161

(51) Int. Cl.
*H01J 1/62* (2006.01)
*H01J 63/04* (2006.01)

(52) U.S. Cl. ..... 313/497; 313/495; 313/496

(58) Field of Classification Search ..... 313/495–497, 313/306, 308–310, 351, 355
See application file for complete search history.

(56) References Cited

U.S. PATENT DOCUMENTS 5,639,330 A 6/1997 Otake et al. ..... 156/239
6,656,007 B2 12/2003 Fushimi et al. ..... 445/24
7,315,115 B1 * 1/2008 Curtin et al. ..... 313/495
2003/0094892 A1 * 5/2003 Moradi et al. ..... 313/495
2004/0104655 A1 * 6/2004 Kodera et al. ..... 313/292
2004/0130260 A1 * 7/2004 Sagawa et al. ..... 313/495
2004/0169459 A1 * 9/2004 Nakamura et al. ..... 313/497
2004/0195958 A1 * 10/2004 Ito et al. ..... 313/496
2005/0184647 A1 * 8/2005 Chang ..... 313/497
2006/0028121 A1 * 2/2006 Satoh et al. ..... 313/496
2006/0038954 A1 2/2006 Shioya ..... 349/155

FOREIGN PATENT DOCUMENTS

JP 2004-55385 2/2004

OTHER PUBLICATIONS

The Patent Office of the People's Republic of China "Notification of First Office Action" Aug. 8, 2008.

* cited by examiner

*Primary Examiner*—Bumsuk Won
(74) *Attorney, Agent, or Firm*—Fitzpatrick, Cella, Harper & Scinto

(57) ABSTRACT

An image display apparatus includes a face plate having a phosphor and an accelerating electrode laminated on the phosphor, and a rear plate having an electron-emitting device emitting an electron to a partial region of the phosphor. An average thickness of the accelerating electrode laminated on the phosphor of a non-irradiation region not to be subjected to an irradiation with the electron emitted from the electron-emitting device, is larger than an average thickness of the accelerating electrode laminated on the phosphor of an irradiation region to be subjected to the irradiation with the electron emitted from the electron-emitting device.

5 Claims, 6 Drawing Sheets

IMAGE DISPLAY APPARATUS HAVING ACCELERATING ELECTRODE WITH UNEVEN THICKNESS

BACKGROUND OF THE INVENTION

1. Field of the Invention

The present invention relates to a structure of an image display apparatus which forms an image with an electron-emitting device.

2. Related Background Art

In this type of image display apparatus, an electron emitted from an electron-emitting device is transmitted through an accelerating electrode which accelerates the electron, and a phosphor member made of a fluorescent material and the like is irradiated with the electron. In the phosphor member, a bright spot (light-emission spot) is generated in a region irradiated with the electron, and the image is formed by the plural bright spots (hereinafter sometimes individual phosphor member is referred to as pixel).

However, the electrons with which the phosphor member is irradiated are scattered on the phosphor member (hereinafter the electron is referred to as "scattered electron"). When the scattered electrons are incident to the adjacent pixel again, a phenomenon called halation in which the scattered electrons causes the light emission from the adjacent pixel is generated, which results in troubles such as color drift.

Therefore, recently many technologies which suppress the halation are disclosed. For example, U.S. Pat. No. 5,639,330 discloses the image display apparatus in which a thickness of the accelerating electrode is adjusted in order to suppress efficiency of re-incidence of the scattered electron to the phosphor member of not more than 30%.

However, in the image display apparatus disclosed in U.S. Pat. No. 5,639,330, the light emission caused by the electrons other than the scattered electrons is also suppressed while the light emission caused by the halation is suppressed. Namely, the light emission caused by the proper electrons emitted from the electron-emitting device is suppressed. Therefore, since the intended brightness cannot be obtained, further improvement is demanded from the viewpoints of high brightness and high contrast.

SUMMARY OF THE INVENTION

In view of the foregoing, an object of the invention is to provide an image display apparatus which can form the image having the high brightness and high contrast while decreasing the color drift to form the image having good color purity by suppressing the halation.

In order to achieve the object, an image display apparatus of the invention including a first substrate which has plural electron-emitting devices; and a second substrate which has a stacking structure formed by an accelerating electrode and plural phosphor members, the accelerating electrode accelerating an electron emitted from the electron-emitting device, the phosphor member emitting light by electron irradiation, the second substrate being arranged while facing the first substrate, wherein each of the plural phosphor members has an irradiated region which is irradiated with the electron emitted from the electron-emitting device and a non-irradiated region which is not irradiated with the electron emitted from the electron-emitting device, and a relationship of $T1<T2$ is met, where T1 is an average thickness of a portion of the accelerating electrode located in the irradiated region and T2 is an average thickness of a portion of the accelerating electrode located in the non-irradiated region.

According to the above configuration, since the average thickness T2 of the accelerating electrode in the portion corresponding to the electron non-irradiated region is larger than the average thickness T1 of the accelerating electrode in the portion corresponding to the electron irradiated region, the energy loss becomes larger in the thickness T2 when the scattered electron which is incident to the phosphor member again is transmitted through the accelerating electrode. Accordingly, the brightness caused by the halation is decreased.

On the other hand, since the average thickness T1 of the accelerating electrode in the portion corresponding to the region irradiated with the electron emitted from the electron-emitting device is smaller than the average thickness T2, the energy of the electron which is emitted from the electron-emitting device to be incident to the phosphor member is kept high. Accordingly the originally intended brightness cannot be decreased.

Therefore, the halation brightness can be decreased in the whole of the phosphor member, which allows the halation brightness to be decreased in the whole of the image display apparatus. Further, since the brightness of the bright spot can be kept high, the image having the high brightness and high contrast can be obtained, and the image having the good color purity in which the color drift is decreased can also be obtained.

In an image display apparatus according to the invention, it is desirable that the accelerating electrode is made of aluminum.

According to the above configuration, because aluminum has a larger optical reflectance when compared with other material, the brightness of the bright spot is further improved in the image display apparatus, which allows the image quality to be improved.

In an image display apparatus according to the invention, the average thickness T2 of the accelerating electrode in the portion corresponding to the electron non-irradiated region ranges from 300 to 400 nm.

According to the above configuration, because the energy loss becomes sufficiently large when the scattered electron is transmitted through the accelerating electrode, halation is suppressed, which allows the image quality to be improved.

DETAILED DESCRIPTION OF THE PREFERRED EMBODIMENT

Referring now to the accompanying drawings, a preferred embodiment of the invention will be described below.

Figure 1:
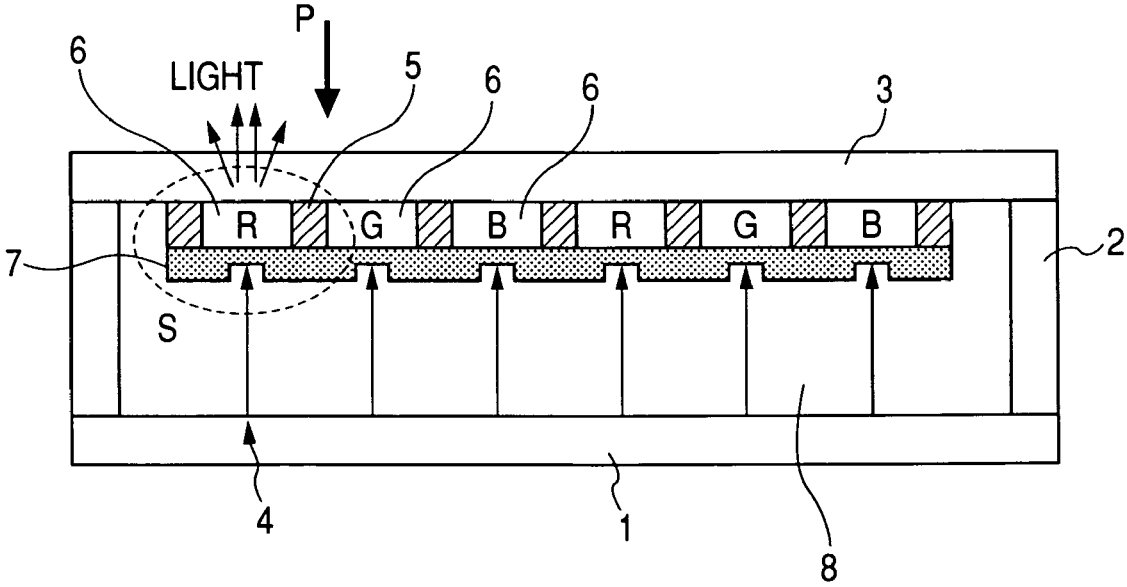
FIG. 1 is a sectional view showing a schematic structure of an image display apparatus according to an embodiment of the invention.

As shown in FIG. 1, an image display apparatus according to the embodiment of the invention includes a first substrate 1, plural phosphor members 6, and a second substrate 3. The first substrate 1 includes plural electron-emitting devices 4. The phosphor members 6 are provided corresponding to the electron-emitting devices 4 respectively. The phosphor member 6 emits the light by the irradiation of the phosphor member 6 with the electron emitted from the corresponding electron-emitting device 4. The second substrate 3 includes an accelerating electrode 7 that is arranged between the plural electron-emitting devices 4 and the plural phosphor members 6. The accelerating electrode 7 accelerates the electrons emitted from the plural electron-emitting devices 4. The plural phosphor members 6 and the accelerating electrode 7 are arranged in a space 8 surrounded by the first substrate 1, the second substrate 3, and side walls 2.

The first substrate 1 is a substrate (rear plate) in which the plural electron-emitting devices 4 are formed in a matrix on a surface.

For example, the plural phosphor members 6 are made of the fluorescent material.

A potential which accelerates the electrons emitted from the plural electron-emitting devices 4 is applied to the accelerating electrode 7, which allows the accelerating electrode 7 to accelerate the electrons. For example, the accelerating electrode 7 has metal backing. It is desirable that the accelerating electrode 7 is made of aluminum. This is because aluminum has relatively small energy loss during electron beam transmission and large optical reflectivity. From the viewpoint of maintenance of the brightness of the phosphor member 6, it is desirable that the potential applied to the accelerating electrode 7 ranges from 8 to 10 kV.

The second substrate 3 is a face plate for electron-beam display device. In order to prevent color mixture, in the second substrate 3, it is desirable that a black matrix 5 is arranged between the phosphor members 6.

Then, the accelerating electrode 7 which is of the feature of the invention will be described in detail.

Figure 2:
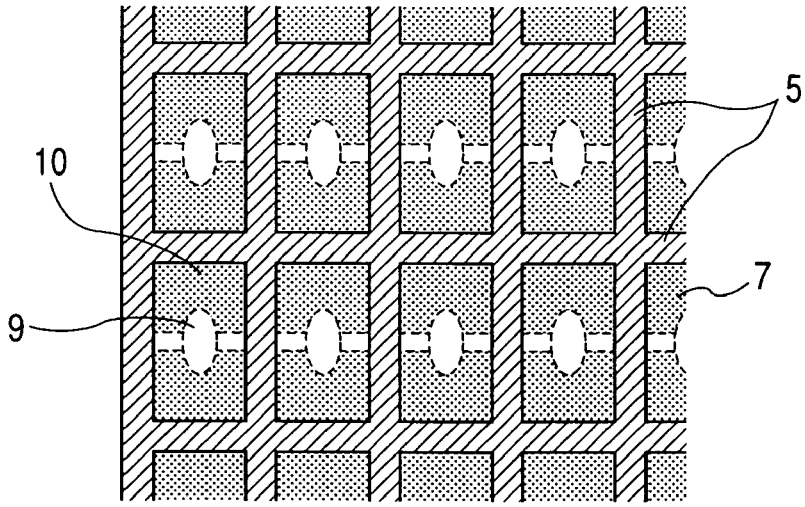
FIG. 2 is a view showing an example of a shape of an accelerating electrode shown in FIG. 1 when viewed from an arrow P side.
Figure 3:
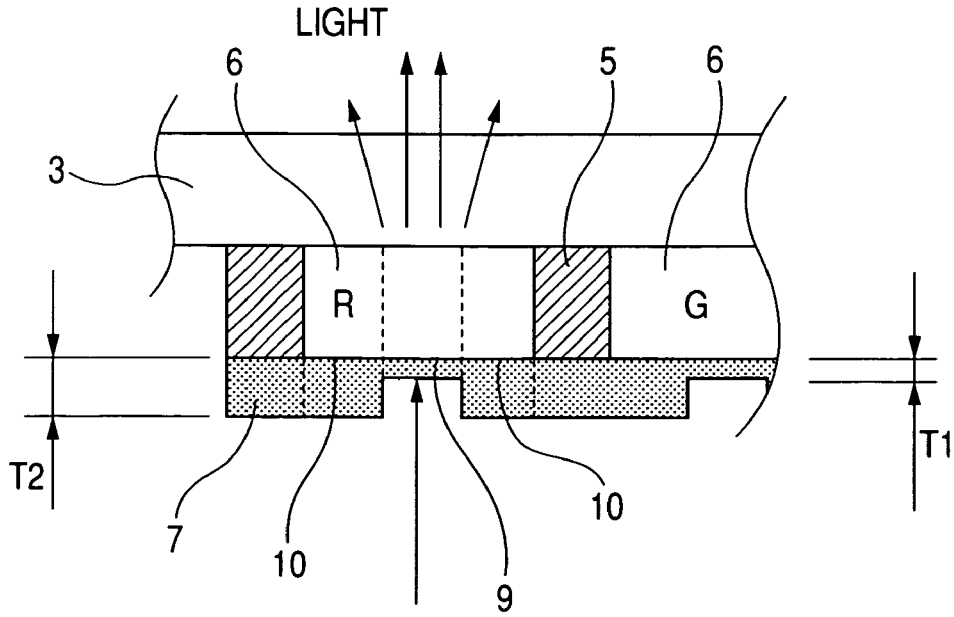
FIG. 3 is a sectional view showing a detail of an S area in the image display apparatus shown in FIG. 1.

As shown in FIG. 2, in the phosphor member 6, an irradiated region (bright spot) of the electron emitted from the electron-emitting device 4 is referred to as center portion 9, and regions (non-irradiated region) except for the center portion 9 is referred to as peripheral portion 10. In this case, as shown in FIG. 3, assuming that the thickness of a portion corresponding to the center portion 9 is T1 and the thickness of a portion corresponding to the peripheral portion 10 is T2, a relationship of T1<T2 holds for a thickness of the accelerating electrode 7. Although the thicknesses of the center portion 9 and peripheral portion 10 are evenly shown in the embodiment, the invention is not limited to the embodiment. For example, assuming that the center portion 9 and the peripheral portion 10 have thickness distributions respectively, even if the center portion 9 partially has the same thickness as T2 and the peripheral portion 10 partially has the same thickness as T1, there is no problem as long as the average thickness of the center portion 9 is smaller than the average thickness of the peripheral portion 10. In order to increase the energy loss in the peripheral portion 10 during the electron beam transmission, it is desirable that the average thickness T2 of the accelerating electrode 7 ranges from 300 to 400 nm in the portion corresponding to the peripheral portion 10 of the phosphor member 6.

Figure 4:
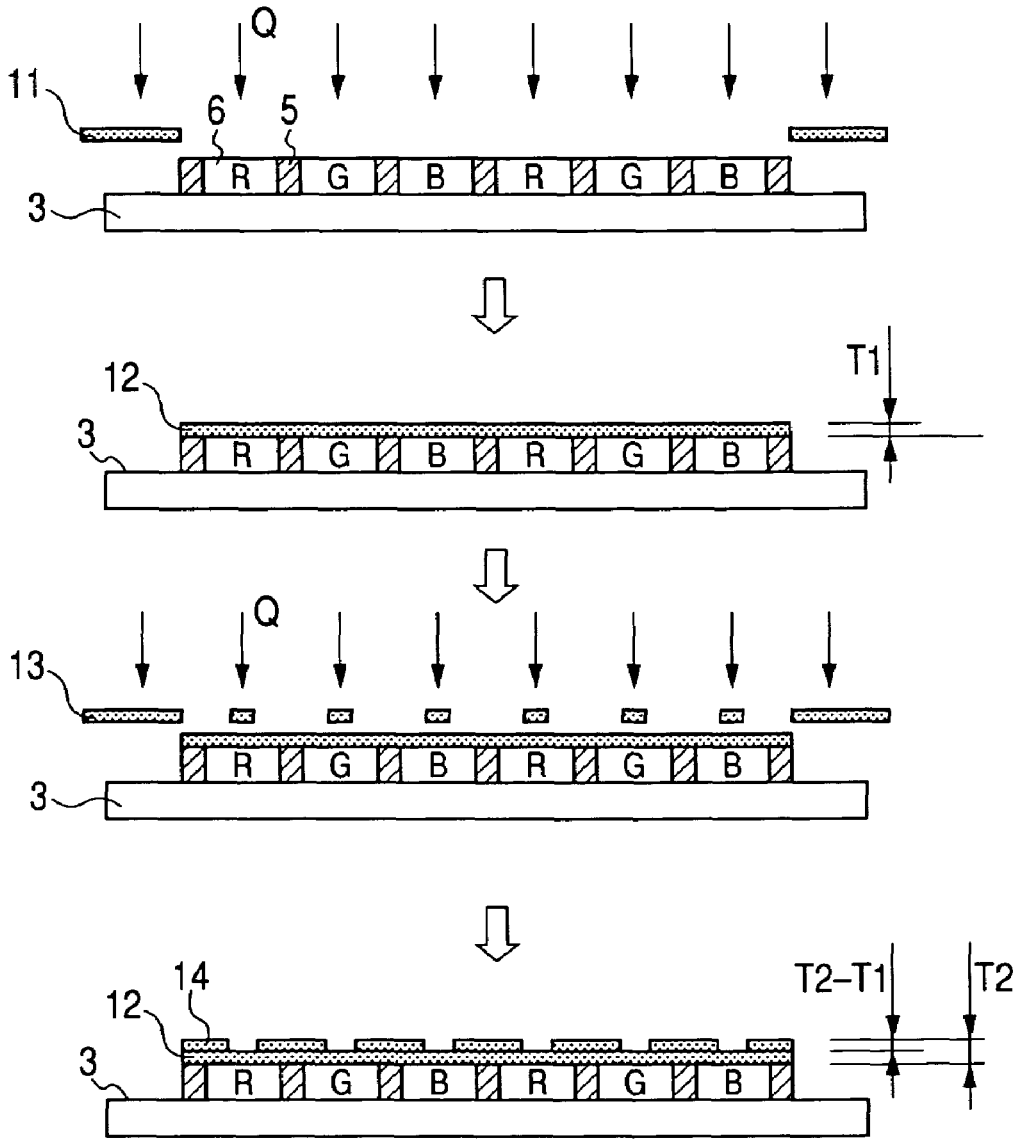
FIG. 4 is an explanatory view showing a procedure of producing the accelerating electrode shown in FIG. 1.

The accelerating electrode 7 can be produced through a procedure shown in FIG. 4.

As shown in FIG. 4, a mask 11 is positioned on the black matrix 5 and the phosphor member 6, and a first metal thin film 12 is formed on the black matrix 5 and the phosphor member 6 by vacuum evaporation.

At this point, the thickness of the first metal thin film 12 is equal to the thickness T1 of the accelerating electrode 7 in the portion corresponding to the center portion 9 of the phosphor member 6.

Figure 5:
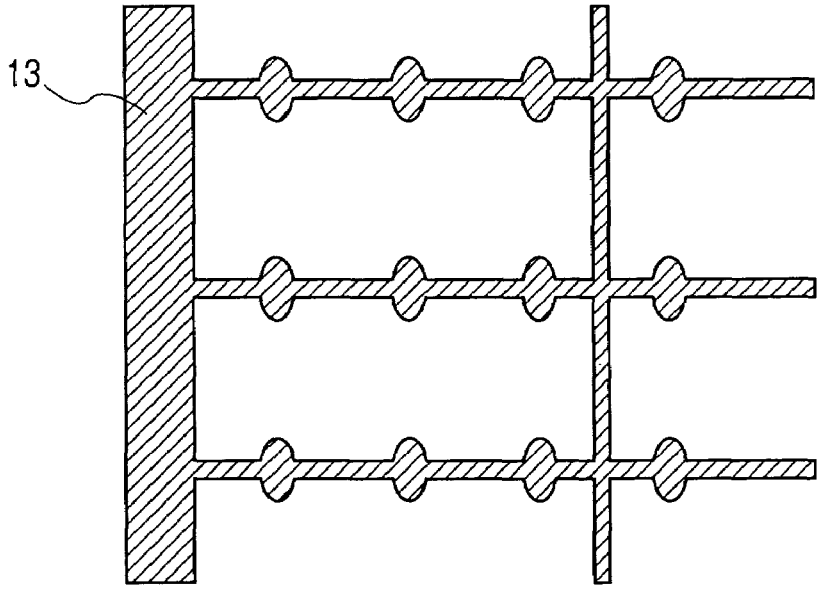
FIG. 5 is a view showing an example of a mask shape used for the production of the accelerating electrode shown in FIG. 2 when viewed from the side of an arrow Q shown in FIG. 4.

Then, a mask 13 is positioned on the black matrix 5 and the phosphor member 6, and a second metal thin film 14 is formed by the vacuum evaporation. An aperture portion of the mask 13, which is used when the phosphor member 6 has the shape shown in FIG. 2, corresponds to the peripheral portion 10 of the phosphor member 6 as shown in FIG. 5.

At this point, the thickness of the second metal thin film 14 is equal to difference of T2−T1 between the thickness T2 of the accelerating electrode 7 in the portion corresponding to the peripheral portion 10 of the phosphor member 6 and the thickness T1 of the accelerating electrode 7 in the portion corresponding to the center portion 9 of the phosphor member 6.

Figure 6:
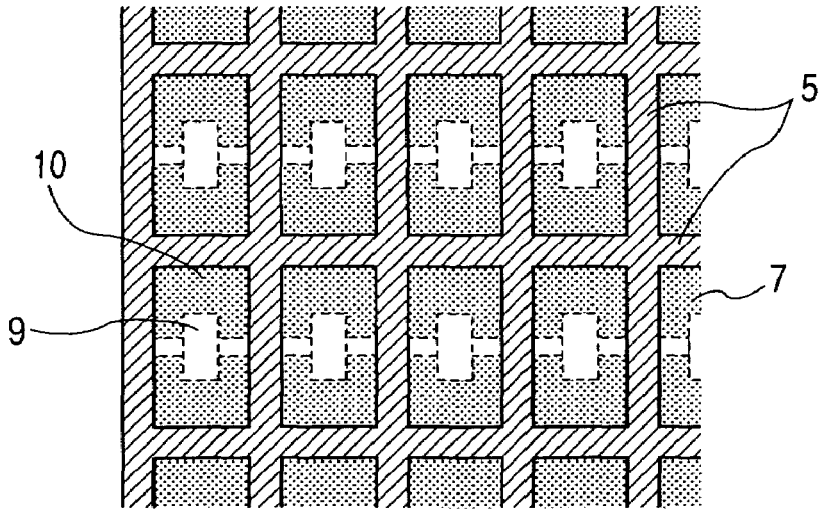
FIG. 6 is a view showing another example of the shape of the accelerating electrode shown in FIG. 1 when viewed from the arrow P side.
Figure 7:
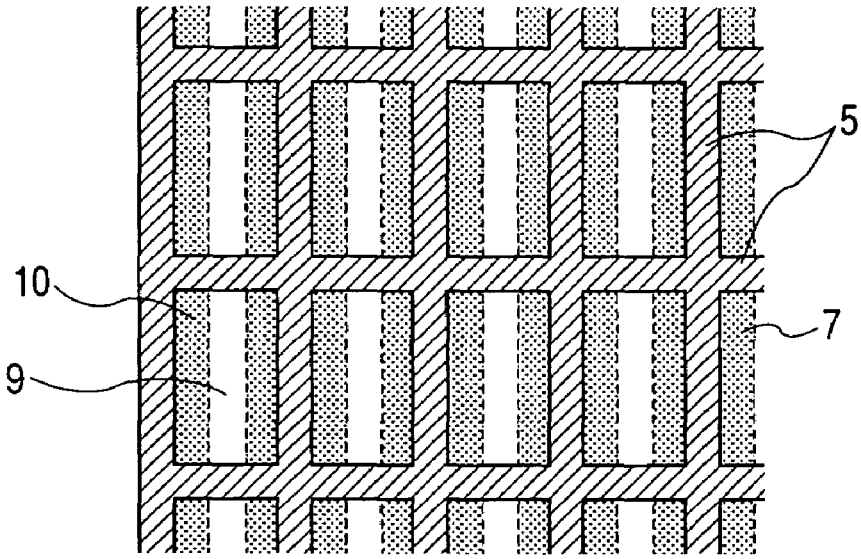
FIG. 7 is a view showing still another example of the shape of the accelerating electrode shown in FIG. 1 when viewed from the arrow P side.
Figure 8:
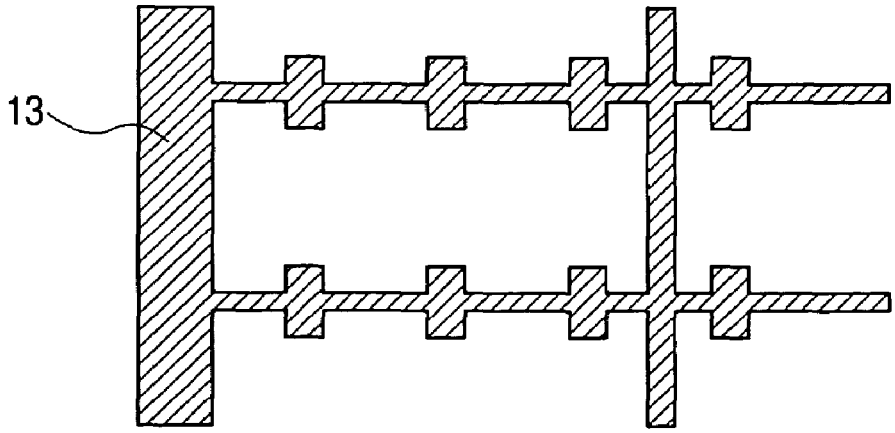
FIG. 8 is a view showing an example of the mask shape used for the production of the accelerating electrode shown in FIG. 6 when viewed from the side of the arrow Q shown in FIG. 4.
Figure 9:
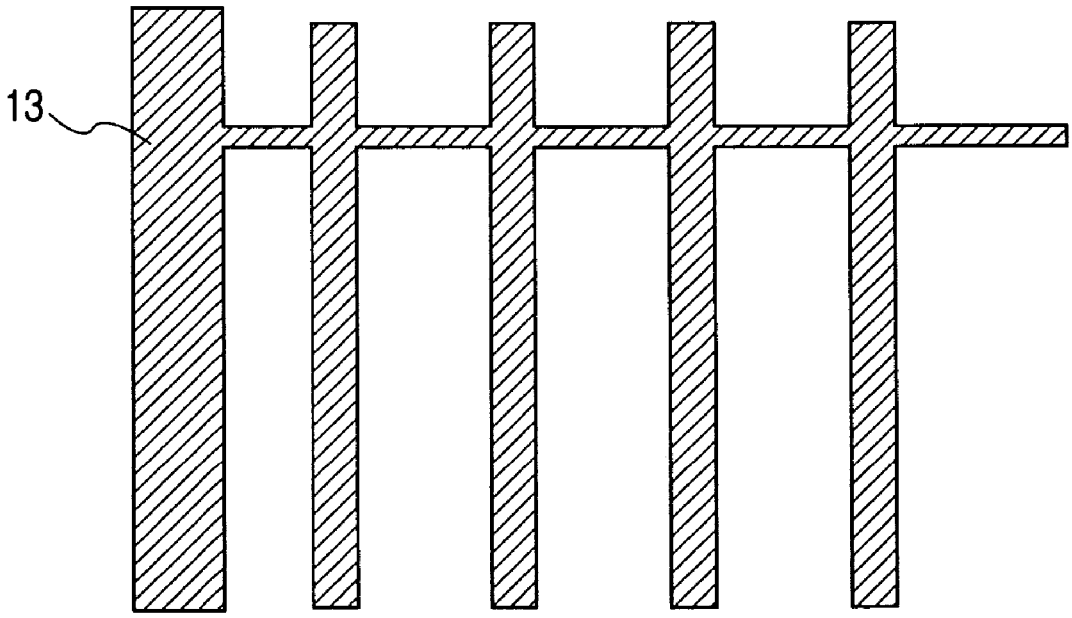
FIG. 9 is a view showing an example of the mask shape used for the production of the accelerating electrode shown in FIG. 7 when viewed from the side of the arrow Q shown in FIG. 4.

In FIG. 2, the shape of the accelerating electrode 7 is formed in a circle in the portion corresponding to the center portion 9 of the phosphor member 6. However, both a rectangle shown in FIG. 6 and a linear shape shown in FIG. 7 can also be adopted for the shape of the center portion 9. FIGS. 8 and 9 show examples of the shape of the mask 13 which is used when the accelerating electrodes 7 in the portion corresponding to the center portion 9 of the phosphor member 6 have the shapes shown in FIGS. 6 and 7 respectively.

Thus, by producing the accelerating electrode 7 in the above manner, the thickness T2 of the accelerating electrode 7 in the portion corresponding to the peripheral portion 10 of the phosphor member 6 can be formed larger than the thickness T1 of the accelerating electrode 7 in the portion corresponding to the center portion 9 of the phosphor member 6.

EXAMPLE

Then, the invention will be described in detail based on specific examples.

At first, the electron energy possessed by the electron emitted from the electron-emitting device 4 when the electron is incident to the phosphor member 6 and the electron energy possessed by the scattered electron when the scattered electron is incident to the phosphor member 6 will be described in the configuration in which an accelerating electrode X is arranged instead of the accelerating electrode 7 according to the embodiment. The thickness of the accelerating electrode X made of aluminum is constant independently of the center portion and the peripheral portion. In the case where the thickness of the accelerating electrode X and the voltage applied to the accelerating electrode X are appropriately changed, Table 1 shows the electron energy possessed by the electron emitted from the electron-emitting device 4 when the electron is passed through the accelerating electrode X to be incident to the pixel on the phosphor member 6 and the electron energy possessed by the scattered electron scattered on the phosphor member 6 when the scattered electron is passed through the accelerating electrode X to be incident to the adjacent pixel on the phosphor member 6 again. Namely, Table 1 shows the electron energy of the electron at the irradiated region (bright spot) and the electron energy contributing to the generation of the halation.

TABLE 1

| Thickness of accelerating electrode 7 | | Voltage applied to accelerating electrode 7 | | |
|---|---|---|---|---|
| | | 10 kV | 9 kv | 8 kv |
| 100 nm | Bright spot | 9.5 keV | 8.4 keV | 7.3 keV |
| | Halation | 7.8 keV | 6.4 keV | 4.9 keV |
| 300 nm | Bright spot | 7.8 keV | 6.4 keV | 4.9 keV |
| | Halation | 2.1 keV | 0.8 keV | 0.1 keV |
| 400 nm | Bright spot | 6.8 keV | 5.3 keV | 3.7 keV |
| | Halation | 0.5 keV | 0 keV | 0 keV |

Then, the accelerating electrode 7 according to the embodiment is arranged to compute the electron energy. Namely, in the accelerating electrode 7 according to the embodiment, the average thickness is set at T1 in the center portion 9 of the phosphor member 6, the average thickness is set at T2 in the peripheral portion 10 of the phosphor member 6, and the relationship of T1<T2 holds for the accelerating electrode 7.

At this point, the electron energy possessed by the scattered electron when the scattered electron is passed through the accelerating electrode 7 in the portion corresponding to the center portion 9 of the phosphor member 6 to reach the phosphor member 6 is set at E(T1), and the electron energy possessed by the scattered electron when the scattered electron is passed through the accelerating electrode 7 in the portion corresponding to the peripheral portion 10 to reach the phosphor member 6 is set at E(T2). An area ratio of the center portion 9 to the whole area of the phosphor member 6 is set at Y. In this case, when the scattered electron is incident to one pixel on the phosphor member 6 again, an average value Eav of the electron energy possessed by the scattered electron is expressed as follows:

$$Eav=Y\times E(T1)+(1-Y)\times E(T2)$$

As the voltage applied to the accelerating electrode 7 is increased, a focusing degree of the electron beam is improved to decrease the electron-beam irradiated region (bright spot), which allows the area of the center portion 9 to be decreased. Therefore, the area ratios of the center-portion 9 are set at 0.28, 0.26, and 0.25 for the voltages applied to the accelerating electrode 7 of 8, 9, and 10 kV respectively.

The electron energy possessed by the electron emitted from the electron-emitting device 4 when the electron is incident to the phosphor member 6 and the electron energy possessed by the scattered electron when the scattered electron is incident to the phosphor member 6 will be described in the case where the combination of the average thicknesses T1 and T2 of the accelerating electrode 7 and the voltage applied to the accelerating electrode 7 are appropriately changed in the configuration in which the accelerating electrode 7 according to the embodiment is arranged. Table 2 shows the electron energy possessed by the electron emitted from the electron-emitting device 4 when the electron is passed through the accelerating electrode 7 to be incident to the pixel on the phosphor member 6 and the electron energy possessed by the scattered electron scattered on the phosphor member 6 when the scattered electron is passed through the accelerating electrode 7 to be incident to the adjacent pixel on the phosphor member 6 again.

TABLE 2

| Thickness of accelerating electrode 7, T1 and T2 | | Voltage applied to accelerating electrode 7 | | |
|---|---|---|---|---|
| | | 10 kV | 9 kV | 8 kV |
| (T1, T2) = (100 nm, 300 nm) | Bright spot (center portion) | 9.5 keV | 8.4 keV | 7.3 keV |
| | Halation Eav | 3.5 keV | 2.3 kev | 1.4 keV |
| = (100 nm, 400 nm) | Bright spot (center portion) | 9.5 keV | 8.4 keV | 7.3 keV |
| | Halation Eav | 2.3 keV | 1.7 keV | 1.4 keV |

As can be seen from Tables 1 and 2, for example, the thickness T1 of the accelerating electrode 7 is set at 100 nm, the thickness T2 of the accelerating electrode 7 is set at 400 nm, the voltage applied to the accelerating electrode 7 is set at 10 kV, and the area ratio Y of the center portion 9 to the whole of the phosphor member 6 is set at 0.25. Then, E(T1), E(T2), and Eav are obtained as follows:

$$E(T1)=7.8(\text{keV})$$

$$E(T2)=0.5(\text{keV})$$

$$Eav=0.25\times 7.8+0.75\times 0.5=2.3(\text{keV})$$

Thus, in the embodiment, the sufficient thickness T2 is kept in the accelerating electrode 7 in the portion corresponding to the peripheral portion 10 of the phosphor member 6, and the energy loss is increased in the accelerating electrode 7 in the portion corresponding to the peripheral portion 10 of the phosphor member 6 when the scattered electron is passed through the accelerating electrode 7. Accordingly, the electron energy E(T2) becomes as small as 0.5 (KeV), and the halation brightness is decreased.

Therefore, the average value Eav of 2.3 (keV) of the electron energy possessed by the scattered electron when the scattered electron is incident to the phosphor member 6 again becomes about 24% the electron energy of 9.5 (keV) possessed by the electron emitted from the electron-emitting device 4 when the electron is incident to the phosphor member 6 in the case where the thickness of the accelerating electrode X is 100 nm. Accordingly, the halation brightness is sufficiently decreased.

On the contrary, the thickness T1 of the accelerating electrode 7 in the portion corresponding to the center portion 9 of the phosphor member 6 is kept thin. Therefore, the electron energy possessed by the electron emitted from the electron-emitting device 4 when the electron is incident to the pixel on the phosphor member 6 (electron energy at the electron irradiated region (bright spot)) is kept at 9.5 (keV), so that the brightness is not decreased at the proper bright spot.

According to the embodiment, while the halation brightness can be decreased, the brightness can be kept high in the proper bright spot. Therefore, the image having the high brightness and high contrast can be obtained, and the image having good color purity in which the color drift is decreased can also be obtained.

This application claims priority from Japanese Patent Application No. 2004-238161 filed on Aug. 18, 2004, which is hereby incorporated by reference herein.

What is claimed is:

1. An image display apparatus comprising:

a face plate having a phosphor and an accelerating electrode laminated on the phosphor; and a rear plate having an electron-emitting device emitting an electron to a partial region of the phosphor, wherein the accelerating electrode includes a first metal thin film laminated on the phosphor and a second metal thin film laminated on a part of the first metal thin film positioned on a non-irradiation region which is not to be subjected to an irradiation with the electron emitted from the electron-emitting device, so that an average thickness of the accelerating electrode of the non-irradiation region is larger than an average thickness of the accelerating electrode of an irradiation region to be subjected to the irradiation with the electron emitted from the electron-emitting device, wherein an average thickness of a portion comprising the first metal thin film and the second metal thin film that is positioned on the non-irradiation region of the accelerating electrode is equal to or more than 300 nm, and wherein the irradiation region and the non-irradiation region are formed in the phosphor.

2. The image display apparatus according to claim 1, wherein the accelerating electrode is made of aluminum.

3. The image display apparatus according to claim 1, wherein the average thickness of the accelerating electrode of the non-irradiation region, ranges from 300 nm to 400 nm.

4. An image display apparatus comprising:

a face plate having a phosphor and an accelerating electrode laminated on the phosphor; and a rear plate having an electron-emitting device emitting an electron to a partial region of the phosphor, wherein the accelerating electrode includes a first metal thin film laminated on both a center portion of the phosphor and a peripheral portion of the phosphor, the center portion is to be subjected to an irradiation with the electron emitted from the electron-emitting device, the peripheral portion is not to be subjected to an irradiation with the electron emitted from the electron-emitting device, and a second metal thin film laminated on a portion of the first metal thin film corresponding to the peripheral portion of the phosphor so that an average thickness of the accelerating electrode laminated on the peripheral portion of the phosphor is larger than an average thickness of the accelerating electrode laminated on the center portion of the phosphor, wherein an average thickness of a portion comprising the first metal thin film and the second metal thin film that is positioned on a non-irradiation region of the accelerating electrode is equal to or more than 300 nm.

5. An image display apparatus comprising:

a face plate having a plurality of phosphors and an accelerating electrode laminated on the plurality of phosphors; and a rear plate having a plurality of electron-emitting devices, wherein, each of the plurality of phosphors has an irradiation region to be subjected to an irradiation with the electron emitted from the plurality of electron-emitting devices and a non-irradiation region not to be subjected to an irradiation with the electron emitted from the plurality of electron-emitting devices, the accelerating electrode comprises, on each of the plurality of phosphors, (i) a first metal thin film laminated on both the irradiation region and the non-irradiation region, and (ii) a second metal thin film laminated on a portion positioned on a non-irradiation region of the first metal thin film, and an average thickness of a portion positioned on the non-irradiation region of each of the plurality of phosphors of the accelerating electrode is equal to or more than 300 nm, and is larger than an average thickness of a portion positioned on the irradiation region of each of the plurality of phosphors of the accelerating electrode.

* * * * *